US009010083B2

(12) United States Patent
Uhm et al.

(10) Patent No.: US 9,010,083 B2
(45) Date of Patent: Apr. 21, 2015

(54) APPARATUS FOR MIXING FUEL IN A GAS TURBINE

(75) Inventors: Jong Ho Uhm, Simpsonville, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 1051 days.

(21) Appl. No.: 13/020,156

(22) Filed: Feb. 3, 2011

(65) Prior Publication Data

US 2012/0198812 A1 Aug. 9, 2012

(51) Int. Cl.

| | |
|---|---|
| ***F23R 3/16*** | (2006.01) |
| ***F23R 3/28*** | (2006.01) |
| ***F23D 14/62*** | (2006.01) |

(52) U.S. Cl.

CPC ..... *F23R 3/286* (2013.01); *F23D 14/62* (2013.01); *F23R 3/16* (2013.01); *F23R 2900/00004* (2013.01); *F23R 2900/00005* (2013.01)

(58) Field of Classification Search

CPC ..... F23R 3/286; F23R 3/283; F23R 2900/03343; F23R 3/50; F23D 14/48; F23D 14/62

USPC ..... 60/39.463, 772, 737, 740, 742, 746, 60/747, 39.37; 239/132, 419.3, 419.5, 239/424, 424.5, 427, 427.3

See application file for complete search history.

(56) References Cited

U.S. PATENT DOCUMENTS

| | | | | |
|---|---|---|---|---|
| 3,771,500 | A | | 11/1973 | Shakiba |
| 4,100,733 | A | * | 7/1978 | Striebel et al. ..... 60/39.463 |
| 4,104,873 | A | | 8/1978 | Coffinberry |
| 4,412,414 | A | | 11/1983 | Novick et al. |
| 5,104,310 | A | | 4/1992 | Saltin |
| 5,205,120 | A | | 4/1993 | Obländer et al. |
| 5,213,494 | A | | 5/1993 | Jeppesen |
| 5,341,645 | A | | 8/1994 | Ansart et al. |
| 5,439,532 | A | | 8/1995 | Fraas |
| 5,592,819 | A | | 1/1997 | Ansart et al. |
| 5,707,591 | A | | 1/1998 | Semedard et al. |
| 6,098,407 | A | | 8/2000 | Korzendorfer et al. |
| 6,123,542 | A | | 9/2000 | Joshi et al. |
| 6,394,791 | B2 | | 5/2002 | Smith et al. |
| 6,438,961 | B2 | | 8/2002 | Tuthill et al. |
| 6,796,790 | B2 | | 9/2004 | Venizelos et al. |
| 6,983,600 | B1 | | 1/2006 | Dinu et al. |
| 7,003,958 | B2 | | 2/2006 | Dinu et al. |
| 7,007,478 | B2 | | 3/2006 | Dinu |
| 7,631,499 | B2 | | 12/2009 | Bland |
| 7,752,850 | B2 | | 7/2010 | Laster et al. |
| 2004/0216463 | A1 | | 11/2004 | Harris |
| 2008/0016876 | A1 | | 1/2008 | Colibaba-Evulet et al. |
| 2008/0304958 | A1 | | 12/2008 | Norris et al. |

(Continued)

OTHER PUBLICATIONS

Co-pending U.S. Appl. No. 12/499,777, filed Jul. 8, 2009.

(Continued)

*Primary Examiner* — Phutthiwat Wongwian
*Assistant Examiner* — Arun Goyal
(74) *Attorney, Agent, or Firm* — Dority & Manning, PA

(57) ABSTRACT

A combustor nozzle includes an inlet surface and an outlet surface downstream from the inlet surface, wherein the outlet surface has an indented central portion. A plurality of fuel channels are arranged radially outward of the indented central portion, wherein the plurality of fuel channels extend through the outlet surface.

15 Claims, 4 Drawing Sheets

(56) References Cited

U.S. PATENT DOCUMENTS

| | | | |
|---|---|---|---|
| 2009/0297996 | A1 | 12/2009 | Vatsky et al. |
| 2010/0008179 | A1 | 1/2010 | Lacy et al. |
| 2010/0024426 | A1 | 2/2010 | Varatharajan et al. |
| 2010/0031662 | A1 | 2/2010 | Zuo |
| 2010/0060391 | A1 | 3/2010 | Ristola et al. |
| 2010/0084490 | A1 | 4/2010 | Zuo et al. |
| 2010/0089367 | A1 | 4/2010 | Johnson et al. |
| 2010/0095676 | A1 | 4/2010 | Uhm et al. |
| 2010/0139280 | A1 | 6/2010 | Lacey et al. |
| 2010/0186413 | A1 | 7/2010 | Lacey et al. |
| 2010/0192581 | A1 | 8/2010 | Ziminsky et al. |
| 2010/0218501 | A1 | 9/2010 | York et al. |
| 2010/0236247 | A1 | 9/2010 | Davis, Jr. et al. |
| 2010/0252652 | A1 | 10/2010 | Johnson et al. |
| 2010/0287942 | A1 | 11/2010 | Zuo et al. |
| 2011/0016871 | A1 | 1/2011 | Kraemer et al. |
| 2011/0057056 | A1* | 3/2011 | Ziminsky et al. ..... 239/398 |
| 2011/0072824 | A1 | 3/2011 | Zuo et al. |
| 2011/0073684 | A1 | 3/2011 | Johnson et al. |
| 2011/0076628 | A1* | 3/2011 | Miura et al. ..... 431/12 |
| 2011/0083439 | A1 | 4/2011 | Zuo et al. |
| 2011/0089266 | A1 | 4/2011 | Stoia et al. |

OTHER PUBLICATIONS

Co-pending U.S. Appl. No. 12/877,385, filed Sep. 8, 2010.
Co-pending U.S. Appl. No. 12/877,399, filed Sep. 8, 2010.
Co-pending U.S. Appl. No. 13/213,460, filed Aug. 19, 2011.

* cited by examiner

APPARATUS FOR MIXING FUEL IN A GAS TURBINE

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves an apparatus for mixing fuel in a gas turbine. Specifically, the present invention describes a combustor nozzle that may be used to supply fuel to a combustor in a gas turbine.

BACKGROUND OF THE INVENTION

Gas turbines are widely used in industrial and power generation operations. A typical gas turbine includes an axial compressor at the front, one or more combustors around the middle, and a turbine at the rear. Ambient air enters the compressor, and rotating blades and stationary vanes in the compressor progressively impart kinetic energy to the working fluid (e.g., air) to produce a compressed working fluid at a highly energized state. The compressed working fluid exits the compressor and flows through nozzles in the combustors where it mixes with fuel and ignites to generate combustion gases having a high temperature, pressure, and velocity. The combustion gases expand in the turbine to produce work. For example, expansion of the combustion gases in the turbine may rotate a shaft connected to a generator to produce electricity.

It is widely known that the thermodynamic efficiency of a gas turbine increases as the operating temperature, namely the combustion gas temperature, increases. However, if the fuel and air are not evenly mixed prior to combustion, localized hot spots may exist in the combustor near the nozzle exits. The localized hot spots increase the chance for flame flash back and flame holding to occur which may damage the nozzles. Although flame flash back and flame holding may occur with any fuel, they occur more readily with high reactive fuels, such as hydrogen, that have a higher reactivity and wider flammability range. The localized hot spots may also increase the generation of oxides of nitrogen, carbon monoxide, and unburned hydrocarbons, all of which are undesirable exhaust emissions.

A variety of techniques exist to allow higher operating temperatures while minimizing localized hot spots and undesirable emissions. For example, various nozzles have been developed to more uniformly mix higher reactivity fuel with the working fluid prior to combustion. Oftentimes, however, the higher reactivity fuel nozzles include multiple mixing tubes that result in a larger differential pressure across the nozzles. In addition, the higher reactivity fuel nozzles often do not include mixing tubes in the center portion of the nozzles. The absence of tubes from the center portion increases the need for higher differential pressure to meet the required mass flow rate. In addition, the absence of tubes from the center portion may create recirculation zones of combustion gases in the vicinity of the center portion that increase the local temperature of the center portion and adjacent mixing tubes. The increased local temperatures may result in increased maintenance and repair costs associated with the nozzle. As a result, continued improvements in nozzle designs that can support increasingly higher combustion temperatures and higher reactive fuels would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor nozzle that includes an inlet surface and an outlet surface downstream from the inlet surface, wherein the outlet surface has an indented central portion. A plurality of fuel channels are arranged radially outward of the indented central portion, wherein the plurality of fuel channels extend through the outlet surface.

Another embodiment of the present invention is a combustor nozzle that includes a circumferential shroud that defines an axial centerline. An outlet surface extends radially inward from the circumferential shroud and has an indented central portion. A plurality of fuel channels circumferentially surround the indented central portion and extend through the outlet surface.

In yet another embodiment, a combustor nozzle includes a recirculation cap, and a plurality of fuel channels circumferentially surround the recirculation cap. Each of the plurality of fuel channels comprises a substantially cylindrical passage, and the recirculation cap includes a downstream indented portion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
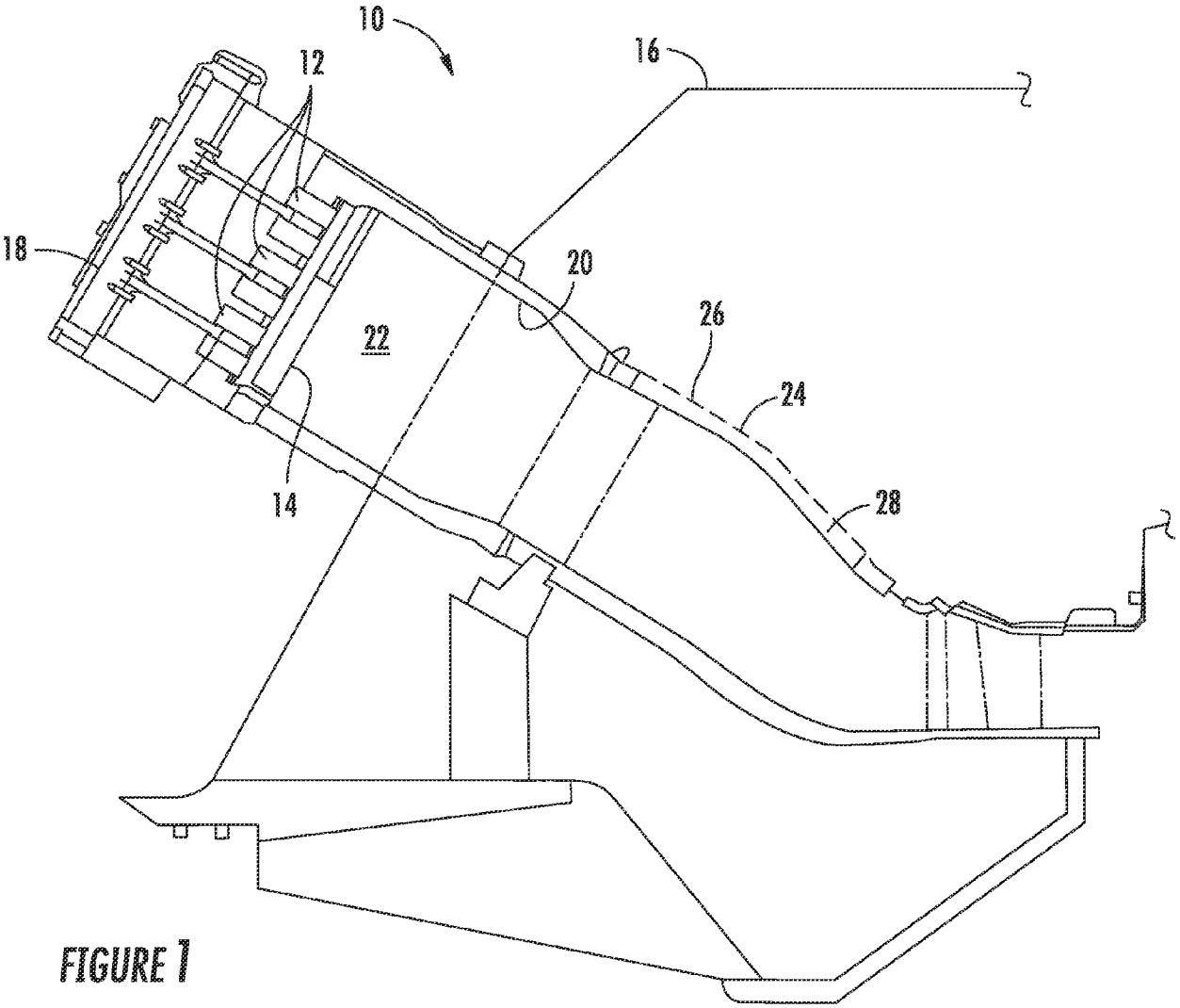
FIG. 1 is a simplified cross-section of a combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a simplified cross-section of a combustor 10 according to one embodiment of the present invention. As shown, the combustor 10 may include one or more nozzles 12 radially arranged in a top cap 14. A casing 16 may surround the combustor 10 to contain the air or compressed working fluid exiting the compressor (not shown). An end cap 18 and a liner 20 generally surround a combustion chamber 22 downstream of the nozzles 12. A flow sleeve 24 with flow holes 26 may surround the liner 20 to define an annular passage 28 between the flow sleeve 24 and the liner 20. The compressed working fluid may pass through the flow holes 26 in the flow sleeve 24 to flow along the outside of the liner 20 to provide film or convective cooling to the liner 20. The compressed working fluid then reverses direction to flow through the one or more nozzles 12 and into the combustion chamber 22 where it mixes with fuel and ignites to produce combustion gases having a high temperature and pressure.

Figure 2:
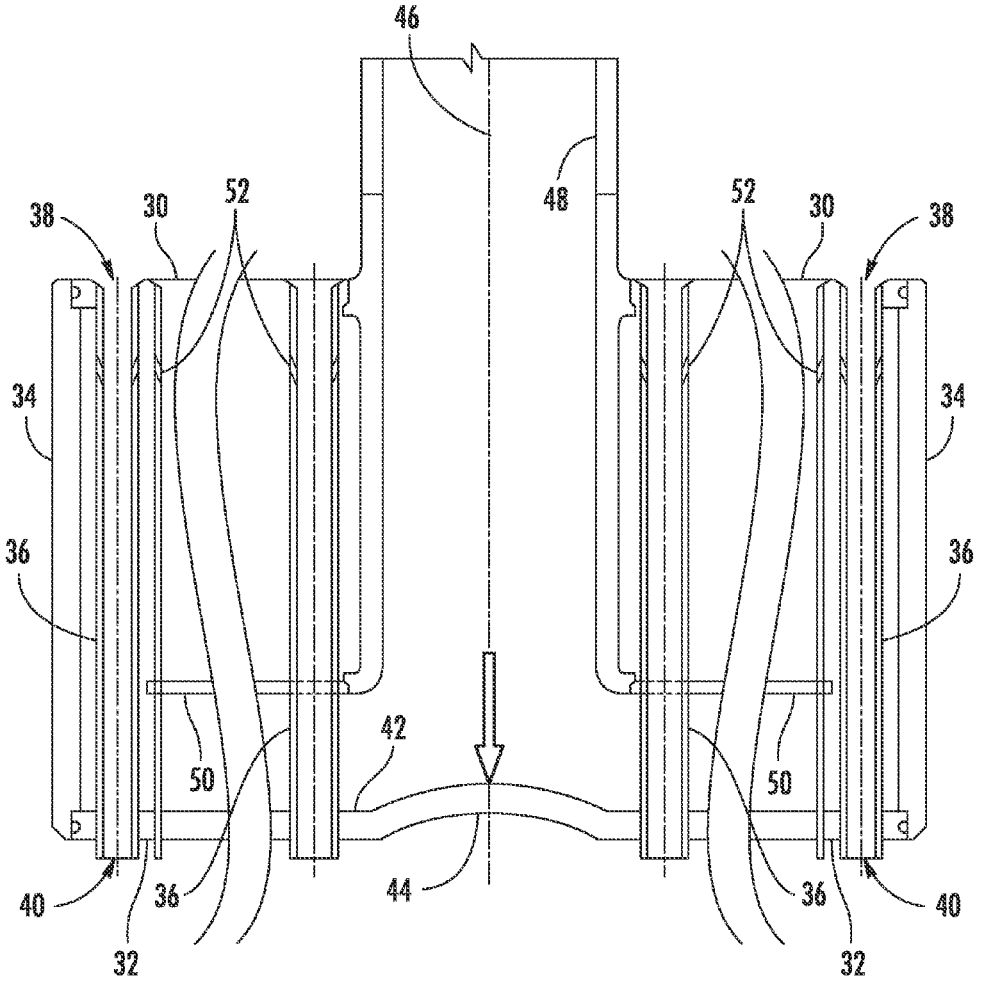
FIG. 2 is an enlarged simplified cross-section of a nozzle shown in FIG. 1 according to one embodiment of the present invention.

As shown in FIG. 2, the nozzle 12 generally includes an inlet surface 30, an outlet surface 32, a shroud 34, and a plurality of fuel channels 36. The inlet surface 30, outlet surface 32, and shroud 34 generally define the volume of the nozzle 12 and one or more plenums therein. For example, as shown in FIG. 2, the inlet surface 30 may define an upstream surface of the nozzle 12, the outlet surface 32 may define a downstream surface of the nozzle 12, and the shroud 34 may circumferentially surround the inlet and outlet surfaces 30, 32 and fuel channels 36 to define the outer perimeter of the nozzle 12. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

The inlet surface 30 may be a planar or curved surface that connects adjacent to an inlet 38 of each of the fuel channels 36. In this manner, the inlet surface 30 directs or guides the compressed working fluid into and through each of the fuel channels 36. The outlet surface 32 may similarly be a planar or curved surface that connects adjacent to an outlet 40 of each of the fuel channels 36. As shown in FIG. 2, the outlet 40 of one or more of the fuel channels 36 may extend approximately 0.01-0.1 inches downstream from the outlet surface 32. In addition, the outlet surface 32 may have an indented or curved central portion or recirculation cap 42 that may be angled or curved upstream or in the direction of the inlet surface 30. The indented or curved central portion or recirculation cap 42 may thus include a recessed or concave portion 44.

The shroud 34 circumferentially surrounds one or more of the inlet surface 30, outlet surface 32, and/or fuel channels 36 to define an axial centerline 46 of the nozzle 12. In this manner, the inlet surface 30, outlet surface 32, and fuel channels 36 extend radially inward from the circumferential shroud 34.

A fuel plenum 48 extends upstream from the inlet surface 30 to a fuel source (not shown) and downstream from the inlet surface 30 into the nozzle 12 to supply fuel to the nozzle 12. In particular embodiments, as shown in FIG. 2, the fuel plenum 48 may extend through the axial length of the nozzle 12 so that the fuel plenum 48 extends upstream from the outlet surface 32 and/or the indented central portion or recirculation cap 42.

A baffle 50 between the inlet and outlet surfaces 30, 32 may connect to the fuel plenum 48 to radially direct fuel inside the nozzle 12 to impinge upon and cool the fuel channels 36 and the outlet surface 32, including the recirculation cap 42 or curved central portion 44. The fuel may then turn upward and enter the fuel channels 36 through fuel ports 52 in the fuel channels 36. The fuel ports 52 thus provide fluid communication between the fuel plenum 48 and the fuel channels 36. Depending on the design needs, some or all of the fuel channels 36 may include fuel ports 52. The fuel ports 52 may simply comprise openings or apertures in the fuel channels 36 that allow the fuel to flow or be injected into the fuel channels 36. The fuel ports 52 may be angled with respect to the axial centerline 46 of the nozzle 12 to vary the angle at which the fuel enters the fuel channels 36, thus varying the distance that the fuel penetrates into the fuel channels 36 before mixing with the air. For example, as shown in FIG. 2, the fuel ports 52 may be angled between approximately 30 and approximately 90 degrees with respect to the axial centerline 46 of the nozzle 12 to enhance mixing as the fuel and compressed working fluid flow through the fuel channels 36 and into the combustion chamber 22.

The fuel channels 36 are generally arranged radially outward of the indented or curved central portion or recirculation cap 42 and may extend through and/or beyond the outlet surface 32. For example, the fuel channels 36 may circumferentially surround the indented or curved central portion or recirculation cap 42 in aligned or staggered concentric circles. Each fuel channel 36 generally comprises a substantially cylindrical passage or tube that may extend continuously from the inlet 38 to the outlet 40. In particular embodiments, the outlet 40 of one or more of the fuel channels 36 may extend approximately 0.01-0.1 inches downstream from the outlet surface 32. The fuel channels 36 may be parallel to one another. Alternately, in particular embodiments, the fuel channels 36 may be slightly canted axially to one another to enhance swirling or mixing of the fuel and air exiting the fuel channels 36 into the combustion chamber 22. The axial cross-section of the fuel channels 36 may be circular, oval, square, triangular, or virtually any geometric shape, as desired.

Figure 3:
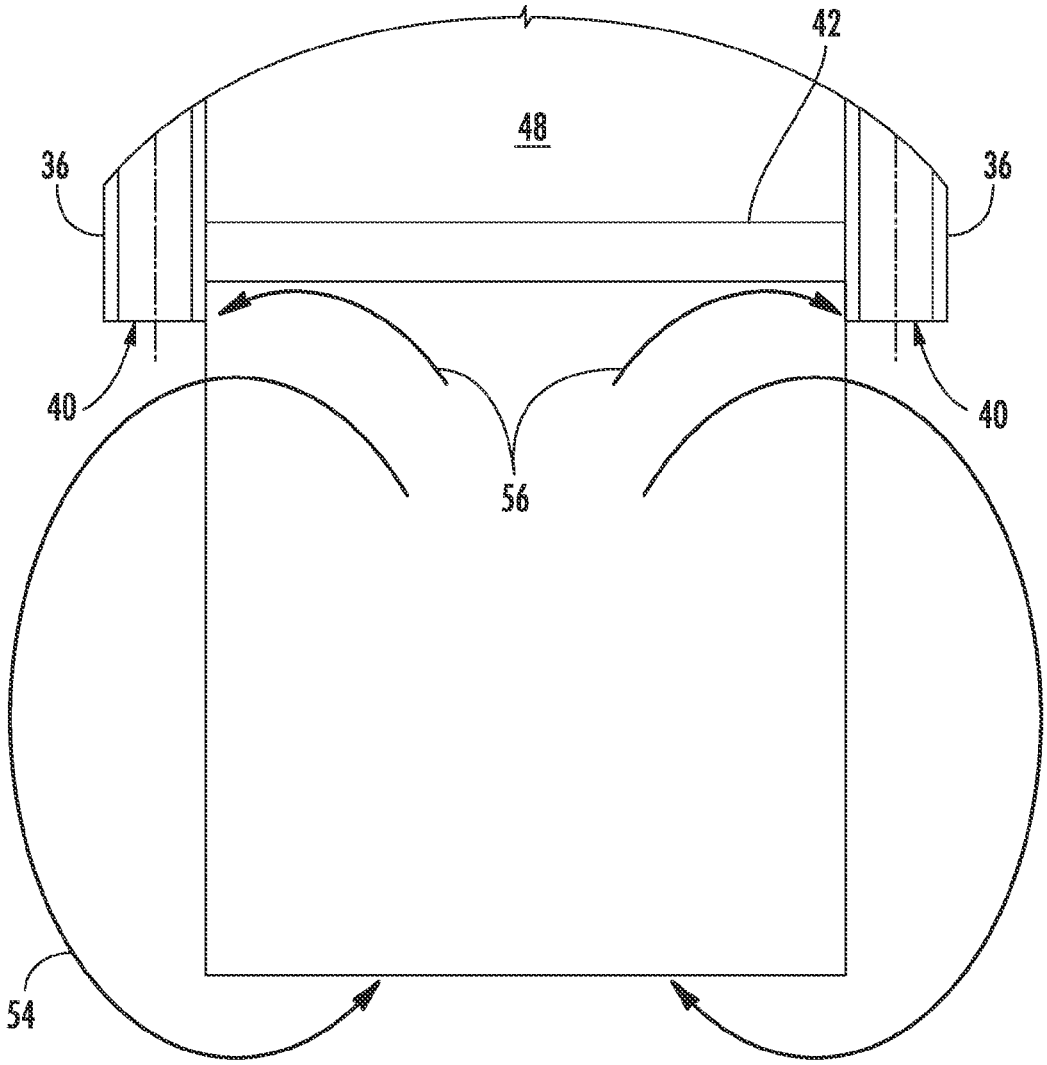
FIG. 3 is an exemplary graph of the velocity profile of a nozzle with a flat outlet surface.
Figure 4:
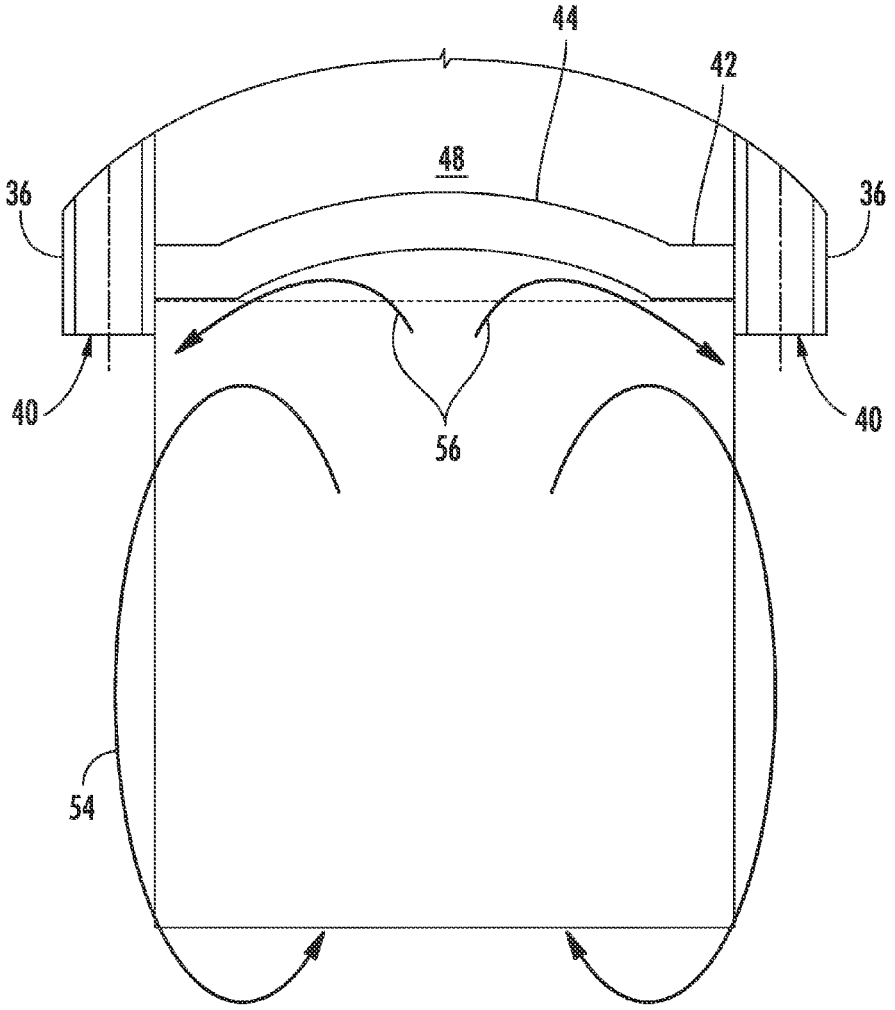
FIG. 4 is an exemplary graph of the velocity profile of the nozzle shown in FIG. 2.

FIGS. 3 and 4 provide exemplary graphs of the fluid flow in the combustion chamber 22 to illustrate the enhanced flow characteristics of various embodiments of the present invention. The arrows 54 represent the swirling vortices of combustion gases that circulate in the vicinity of the indented or curved central portion or recirculation cap 42. As shown in FIG. 3, the substantially flat surface of the recirculation cap 42 produces lower velocities of the combustion gases proximate to the central portion of the recirculation cap 42. This produces higher surface temperatures of the central portion of the recirculation cap 42 and adjacent fuel channels 36. Moreover, recirculated combustion products 56 may contact and heat the fuel channel outlet 40 of the adjacent fuel channels 36. This may result in accelerated wear and/or premature failure of the nozzle 12. In contrast, FIG. 4 illustrates that the indented or concave portion 44 of the recirculation cap 42, as shown in FIG. 2, produces relatively higher velocities of the combustion gases proximate to the indented or concave portion 44 of the recirculation cap 42. In addition, the indented or concave portion 44 of the recirculation cap 42 guides the recirculated combustion products 56 to avoid contact with the fuel channel outlet 40 of the adjacent fuel channels 36. This produces lower surface temperatures of the center portion or recirculation cap 42 and adjacent fuel channels 36 which reduces wear and/or damage to the nozzle 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor nozzle comprising:

a. a first plate defining an inlet surface;

b. a second plate downstream from the inlet surface, the second plate having an inner surface facing an inner surface of the first plate, and an outlet surface axially spaced from the inner surface, the second plate including a central portion which is formed as a solid disk and defined along the outlet surface, wherein the outlet surface of the central portion is dimpled inward from the outlet surface towards the first plate;

c. a fuel plenum defined between the inner surface of the first plate and the inner surface of the second plate wherein each of the fuel channels of the plurality of fuel channels is in fluid communication with the fuel plenum; and d. a plurality of fuel channels annularly arranged radially outward of the dimpled central portion, wherein the plurality of fuel channels extend through the inner and the outlet surface.

2. The combustor nozzle as in claim 1, wherein each of the plurality of fuel channels comprises a substantially cylindrical passage that extends downstream from the inlet surface.

3. The combustor nozzle as in claim 1, further comprising a shroud circumferentially surrounding at least one of the inlet surface, outlet surface, or plurality of fuel channels, wherein the shroud at least partially defines the fuel plenum.

4. The combustor nozzle as in claim 1, further comprising a baffle between the inlet and outlet surfaces, wherein the baffle at least partially defines the fuel plenum.

5. The combustor nozzle as in claim 1, wherein each fuel channel of the plurality of fuel channels includes a fuel port in fluid communication with the fuel plenum.

6. The combustor nozzle as in claim 5, wherein the at least one fuel port is angled approximately 30 to approximately 90 degrees with respect to an axial centerline of the combustor nozzle.

7. A combustor nozzle, comprising:

a. a circumferential shroud, wherein the circumferential shroud defines an axial centerline;

b. a plate extending radially and circumferentially across one end of the shroud, the plate defining an inner surface and an outlet surface that is axially spaced from the inner surface, the plate extending radially inward from the circumferential shroud, wherein the outlet surface has dimpled central portion which is formed as a solid disk and extends inwardly towards the inner surface with respect to the outlet surface;

c. a plurality of fuel channels circumferentially surrounding the dimpled central portion, wherein the plurality of fuel channels extend through the outlet surface;

d. a fuel plenum at least partially defined by the inner surface of the plate and an inner surface of the shroud, wherein each of the fuel channels of the plurality of fuel channels extends through and is in fluid communication with the fuel plenum.

8. The combustor nozzle as in claim 7, wherein each of the plurality of fuel channels comprises a substantially cylindrical passage that extends downstream from the outlet surface.

9. The combustor nozzle as in claim 7, further comprising a baffle upstream from the inner surface of the plate, wherein the baffle at least partially defines the fuel plenum.

10. The combustor nozzle as in claim 7, wherein each fuel channel of the plurality of fuel channels includes a fuel port in fluid communication with the fuel plenum.

11. The combustor nozzle as in claim 10, wherein the at least one fuel port is angled approximately 30 to approximately 90 degrees with respect to the axial centerline.

12. A combustor nozzle comprising:

a. a recirculation cap defining an inner surface axially spaced from an opposing outlet surface, wherein the outlet surface defines a central portion which is formed as a solid disk;

b. a plurality of fuel channels circumferentially surrounding the central portion, wherein the plurality of fuel channels provide for fluid communication through the inner surface and the outlet surface of the recirculation cap;

c. wherein the inner surface of the recirculation cap at least partially defines a fuel plenum within the recirculation cap, and wherein the plurality of fuel channels are in fluid communication with the fuel plenum; and d. wherein the outlet surface of the recirculation cap defines a dimpled portion disposed along the central portion and extending inwardly towards the inner surface with respect to the outlet surface.

13. The combustor nozzle as in claim 12, further comprising a shroud circumferentially surrounding the plurality of fuel channels.

14. The combustor nozzle as in claim 12, further comprising a baffle axially spaced from the inner surface of the recirculation cap, wherein the baffle at least partially defines the fuel plenum.

15. The combustor nozzle as in claim 12, wherein each fuel channel of the plurality of fuel channels includes a fuel port in fluid communication with the fuel plenum.

* * * * *